US007886768B2

(12) United States Patent
Kobayashi et al.

(10) Patent No.: US 7,886,768 B2
(45) Date of Patent: Feb. 15, 2011

(54) HYDRAULIC FLUID TANK

(75) Inventors: Hidehiko Kobayashi, Hirakata (JP); Kenzo Kimoto, Hirakata (JP)

(73) Assignee: Komatsu Ltd., Tokyo (JP)

( * ) Notice: Subject to any disclaimer, the term of this patent is extended or adjusted under 35 U.S.C. 154(b) by 957 days.

(21) Appl. No.: 11/666,915

(22) PCT Filed: Sep. 14, 2005

(86) PCT No.: PCT/JP2005/016918

§ 371 (c)(1),
(2), (4) Date: May 3, 2007

(87) PCT Pub. No.: WO2006/048976

PCT Pub. Date: May 11, 2006

(65) Prior Publication Data

US 2008/0121289 A1 May 29, 2008

(30) Foreign Application Priority Data

Nov. 4, 2004 (JP) ..... 2004-319995

(51) Int. Cl.
*B65D 6/00* (2006.01)
*B65D 25/04* (2006.01)
*F17C 3/00* (2006.01)

(52) U.S. Cl. ..... 137/576; 137/574; 220/563; 220/564; 96/350

(58) Field of Classification Search ..... 137/573, 137/574, 576; 220/4.12, 563, 564, 555; 96/350
See application file for complete search history.

(56) References Cited

U.S. PATENT DOCUMENTS

| | | | | | |
|---|---|---|---|---|---|
| 1,392,892 | A | * | 10/1921 | Imber | 220/563 |
| 2,419,218 | A | * | 4/1947 | Jannsen | 114/79 W |
| 2,703,607 | A | * | 3/1955 | Simmonds | 137/265 |
| 3,284,991 | A | * | 11/1966 | Ploeger et al. | 95/30 |
| 3,976,124 | A | * | 8/1976 | Brown | 165/103 |
| 4,210,176 | A | * | 7/1980 | Emming | 137/573 |
| 6,116,454 | A | * | 9/2000 | Henderson et al. | 220/563 |
| 2004/0187931 | A1 | | 9/2004 | Crossman et al. | |

FOREIGN PATENT DOCUMENTS

| | | | | |
|---|---|---|---|---|
| DE | 36 43 265 | C2 | | 7/1988 |
| DE | 102 42 050 | A1 | | 3/2004 |
| JP | 57-171176 | U | | 4/1981 |
| JP | 59137601 | A | * | 8/1984 |
| JP | 59-190502 | A | | 10/1984 |
| JP | 60-107402 | U | | 7/1985 |
| JP | 61-114102 | U | | 7/1986 |
| JP | 04-105604 | U | | 9/1992 |
| JP | 05-321902 | A | | 12/1993 |

* cited by examiner

*Primary Examiner*—John Rivell
*Assistant Examiner*—Atif H Chaudry
(74) *Attorney, Agent, or Firm*—Global IP Counselors

(57) ABSTRACT

A hydraulic fluid tank includes a tank main member of a box-shaped member with a return port and a drawing port that are opened therein; and a divider member that is located in an interior of the tank main member and defines a path of fluid flow from the return port to the drawing port. In addition, the divider member is formed so that the fluid flow makes at least one turn in a vertical direction and at least one turn in a width direction.

7 Claims, 10 Drawing Sheets

HYDRAULIC FLUID TANK

CROSS-REFERENCE TO RELATED APPLICATIONS

This U.S. National stage application claims priority under 35 U.S.C. §119(a) to Japanese Patent Application No. 2004-319995, filed in Japan on Nov. 4, 2004, the entire contents of which are hereby incorporated herein by reference.

TECHNICAL FIELD

This invention relates to a hydraulic fluid tank.

BACKGROUND INFORMATION

A construction machine such as hydraulic shovel includes a lower travel portion 80, an upper revolving portion 81, and a work equipment 82 which is connected to this upper revolving portion 81, as shown in FIG. 11. In addition, the work equipment 82 includes a boom 83 which protrudes from the upper revolving portion 81, an arm 84 which is connected to this boom 83, a bucket 85 which is mounted to this arm 84, and so on. Additionally, the boom 83 swings by operation of a boom cylinder mechanism 86. The arm 84 swings by operation of an arm cylinder mechanism 87. The bucket 85 swings by operation of a bucket cylinder mechanism 88.

Furthermore, the aforementioned cylinder mechanism 86, 87 and 88 are hydraulically operated. Accordingly, a hydraulic circuit with a hydraulic fluid tank is constructed. A hydraulic fluid tank with a divider plate which divides the interior thereof is known (for example, see Japanese Patent Laid-Open Publication TOKUKAI No. HEI 5-321902). In a hydraulic fluid tank stated in the foregoing Patent Document 1, a box-shaped tank main member 90 is provided with a divider plate 92 parallel to a bottom plate 91 of this tank main member 90, as shown in FIGS. 9 and 10. In addition, a drawing port 93 is opened in the bottom plate 91, and a return port 94 is located above the divider plate 92. That is, the tank main member 90 stores hydraulic fluid, and a hydraulic pump draws the hydraulic fluid of the tank main member 90 through the drawing port 93. Return hydraulic fluid from the cylinder mechanisms (actuator) 86, 87 and 88 is returned to the tank main member 90 through the return port 94. Additionally, in this hydraulic fluid tank, the divider plate 92 is provided with a hole 95 for a filter (strainer) 97 and a number of holes 96.

That is, in this hydraulic fluid tank, in a case where the fluid surface sways, the divider plate 93 disturbs the upward movement of the fluid surface to prevent that the filter 97 located under the divider plate 92 is exposed to air.

SUMMARY OF THE INVENTION

Problems Solved by the Invention

However, in the hydraulic fluid tank stated in the foregoing Japanese Patent Laid-Open Publication TOKUKAI No. HEI 5-321902, since the divider plate 92 is provided with a number of the holes 96, the distance from the return port 94 to the drawing port 93 is short. For this reason, there is a problem that is hard to remove air from fluid containing air (fluid with air mixed therein).

The present invention is aimed at solving the above problem, and its object is to provide a hydraulic fluid tank that can stably remove bubbles and reduce the tank volume to be compact in size.

Means to Solve the Problems

A hydraulic fluid tank according to a first aspect of the present invention includes a tank main member of a box-shaped member with a return port and a drawing port that are opened therein; and a divider member that is located in the interior of the tank main member and defines a path of fluid flow from the return port to the drawing port. The divider member is formed so that the fluid flow makes at least one turn in a vertical direction and at least one turn in a width direction.

In a hydraulic fluid tank according to a second aspect of the present invention, in the hydraulic fluid tank according to the first aspect of the present invention, the drawing port is located in a lower part of the tank main member in the middle in the width direction.

In a hydraulic fluid tank according to a third aspect of the present invention, in the hydraulic fluid tank according to the second aspect of the present invention, the divider member includes a horizontal divider portion that is located above the drawing port, and a vertical divider portion that extends downward from one end of the horizontal divider portion. In addition, the return port is located outward of the vertical divider portion relative to the drawing port.

In a hydraulic fluid tank according to a fourth aspect of the present invention, in the hydraulic fluid tank according to any of the first to third aspects of the present invention, the divider member includes a pair of vertical divider plates and a horizontal divider plate that vertically divides a part between the vertical divider plates so as to divide the interior of the tank main member into a first chamber outside of one of the vertical divider plate, a second chamber of an upper divided part between the vertical divider plates, a third chamber outside of the other of the vertical divider plates and a fourth chamber of a lower divided part between the vertical divider plates. In addition, the return port is opened in the first chamber, and the drawing port is opened in the fourth chamber.

In a hydraulic fluid tank according to a fifth aspect of the present invention, in the hydraulic fluid tank according to the fourth aspect of the present invention, the pair of vertical divider plates and the horizontal divider plate are connected to a surface that has a maximum area in surfaces defining the tank main member.

In a hydraulic fluid tank according to a sixth aspect of the present invention, in the hydraulic fluid tank according to the fourth or fifth aspect of the present invention, the pair of vertical divider plates and the horizontal divider plate are connected to a side plate of the tank main member.

In a hydraulic fluid tank according to a seventh aspect of the present invention, in the hydraulic fluid tank according to any of the fourth to sixth aspects of the present invention, clearances are provided among the vertical divider plates and horizontal divider plate.

In a hydraulic fluid tank according to an eighth aspect of the present invention, in the hydraulic fluid tank according to any of the fourth to seventh aspects of the present invention, the tank further includes a strainer corresponding to the drawing port, and the horizontal divider plate is provided with a strainer-passage hole. In addition, the strainer-passage hole is substantially closed by a lid member that is attached to a strainer rod.

In a hydraulic fluid tank according to a ninth aspect of the present invention, in the hydraulic fluid tank according to any of the first to eighth aspects of the present invention, a clearance is provided between an edge of the divider member and an inner surface of the tank main member.

A hydraulic fluid tank according to a tenth aspect of the present invention includes a tank main member of a box-shaped member including a pair of vertical divider plates, and a horizontal divider plate that are located in the interior thereof. The horizontal divider plate vertically divides a part between the vertical divider plates. In addition, the interior of the tank main member is divided into a first chamber outside of one of the vertical divider plates, a second chamber of an upper divided part between the vertical divider plates, a third chamber outside of the other of vertical divider plates and a fourth chamber of a lower divided part between the vertical divider plates. Additionally, the first chamber is provided with a return port that is opened therein, and the fourth chamber is provided with a drawing port that is opened therein.

A hydraulic fluid tank according to an eleventh aspect of the present invention includes a tank main member of a box-shaped member, and a strainer that is located in a lower part of this tank main member in the middle in a width direction. In addition, the interior of the tank main member is divided by a divider member including a horizontal divider plate that is located above the strainer, and a vertical divider plate that extends downward from one end of this horizontal divider plate. Additionally, the horizontal divider plate is provided with a strainer-passage hole, and this strainer-passage hole is substantially closed by a lid member that is attached to a strainer rod. Moreover, a return port is opened on one side outward of the vertical divider plate in a width direction, and a drawing port is opened under the horizontal divider plate.

Effects of the Invention

In the hydraulic fluid tank according to the first aspect of the present invention, the divider plate is formed so that the hydraulic fluid flow makes at least one turn in a vertical direction and at least one turn in a width direction. For this reason, the distance from the return port to the drawing port can be long, therefore, it is possible to improve removal of air (removal of bubbles) from fluid containing air (fluid mixed with air).

In the hydraulic fluid tank according to the second aspect of the present invention, since the drawing port is located in a lower part of the tank main member in the middle in the width direction, even in a case where the tank main member is inclined, it is possible to enhance drawing of fluid from the drawing port.

In the hydraulic fluid tank according to the third aspect of the present invention, the fluid which flows into the tank main member through the return port that is opened outward of the horizontal divider portion flows first upward and then flows toward other side, in the width direction in a part above the horizontal divider portion, and, subsequently, flows downward on the other side in the width direction. The fluid flows additionally into a part under the horizontal divider portion thorough an opening of the divider portion on the other side, and drawn through the drawing port that is located under the horizontal divider portion. For this reason, the distance from the return port to the drawing port can be long, therefore, it is possible to improve removal of air (removal of bubbles) from fluid containing air (fluid mixed with air). Since this construction provides fluid less containing air, the tank volume can be reduced compared with conventional tanks, and the tank can be compact in size.

In the hydraulic fluid tank according to the fourth aspect of the present invention, the tank main member is divided into four chambers. In addition, fluid which flows into the first chamber through the return port flows thorough the second chamber into the third chamber, and, additionally, from the third chamber through the fourth chamber, then is drawn through the drawing port. For this reason, the distance from the return port to the drawing port can be long, therefore, it is possible to improve removal of air (removal of bubbles) from fluid containing air (fluid mixed with air). Since this construction provides fluid less containing air, the tank volume can be reduced, and it is possible to improve efficiency of air removal.

In the hydraulic fluid tank according to the fifth aspect of the present invention, since the pair of vertical divider plates and the horizontal divider plate are connected to the tank main member, these three divider plates can serve as reinforcement members. For this reason, it is possible to reduce plate thickness of the tank main member, or reduce the number of other reinforcement members. Particularly, since the vertical divider plates and the horizontal divider plate are connected to a surface that have a maximum area in surfaces defining the tank main member, they provide a high reinforcement effect.

In the hydraulic fluid tank according to the sixth aspect of the present invention, since the pair of vertical divider plates and the horizontal divider plate are connected to the tank main member, these three divider plates can serve as reinforcement members. For this reason, it is possible to reduce plate thickness of the tank main member, or reduce the number of other reinforcement members.

In the hydraulic fluid tank according to the seventh aspect of the present invention, since clearances are provided among the vertical divider plates and horizontal divider plate, it is possible relieve stress when fluid sways. In addition, even if a fluid amount is reduced to an insufficient extent, this construction can facilitate that fluid can reach the drawing port.

In the hydraulic fluid tank according to the eighth aspect of the present invention, the strainer-passage hole can be substantially closed by the lid member, thus, it is possible to prevent that this strainer-passage hole forms a fluid path. Accordingly, the lid member prevents that a bypass is formed from the second chamber to the fourth chamber, thus, it is possible to prevent that the distance from the return port to the drawing port is reduced. Therefore, it is possible to prevent reduction of air removal (bubble removal) function.

In the hydraulic fluid tank according to the ninth aspect of the present invention, since a clearance is provided between an edge of the divider plate and an inner surface of the tank main member, it is possible relieve stress when fluid sways. In addition, even if a fluid amount is reduced to an insufficient extent, this construction can facilitate that fluid can reach the drawing port.

In the hydraulic fluid tank according to the tenth aspect of the present invention, the tank main member is divided into four chambers. In addition, fluid which flows into the first chamber through the return port flows thorough the second chamber into the third chamber and, additionally, from the third chamber through the strainer in the fourth chamber, then is drawn through the drawing port by a hydraulic pump. For this reason, the distance from the return port to the drawing port can be long, therefore, it is possible to improve removal of air (removal of bubbles) from fluid containing air (fluid mixed with air). Since this construction provides fluid less containing air, the tank volume can be reduced, and it is possible to improve efficiency of air removal.

In the hydraulic fluid tank according to the eleventh aspect of the present invention, fluid which flows into the tank main member through the return port that is opened on one side outward of the vertical divider plate in a width direction flows first upward and then flows toward the other side in the width direction in a part above the horizontal divider plate, and, subsequently, flows downward on the other side in the width direction. The fluid flows additionally into a part under the horizontal divider plate thorough an opening of said divider plate on the other side, and flows through the strainer that is located under the horizontal divider plate and then drawn through the drawing port by a hydraulic pump. For this reason, the distance from the return port to the drawing port can be long, therefore, it is possible to improve removal of air (removal of bubbles) from fluid containing air (fluid mixed with air). Since this construction provides fluid less containing air, the tank volume can be reduced compared with conventional tanks, and the tank can be compact in size. In addition, the strainer-passage hole can be substantially closed by a lid member, thus, it is possible to prevent that this strainer-passage hole forms a fluid path. Accordingly, it is possible to prevent that the distance from the return port to the drawing port is reduced. Therefore, it is possible to prevent reduction of air removal (bubble removal) function.

DESCRIPTION OF THE REFERENCE NUMERALS

1: tank main member; 2 and 3: strainer; 4 and 5: side plate; 10: vertical divider plate; 11: vertical divider plate; 12: horizontal divider plate; 13: first chamber; 14: second chamber; 15: third chamber; 16: fourth chamber; 17*a* and 17*b*: return port; 18*a* and 18*b*: drawing port; 43 and 44: strainer-passage hole; 45 and 46: strainer rod; 51 and 52: lid member; 55: tank main member; 56: strainer; 57: horizontal divider plate; 58: vertical divider plate; 59: divider member; 60: strainer-passage hole; 61: strainer rod; 62: lid member; 63: return port; 64: drawing port; 65: opening; 72: drawing port; 73: return port; 74: strainer; 75: tank main member; 76: return port; 77: horizontal divider plate; 78: vertical divider plate; 80: strainer; and 81: divider member.

DETAILED DESCRIPTION OF THE INVENTION

Figure 1:
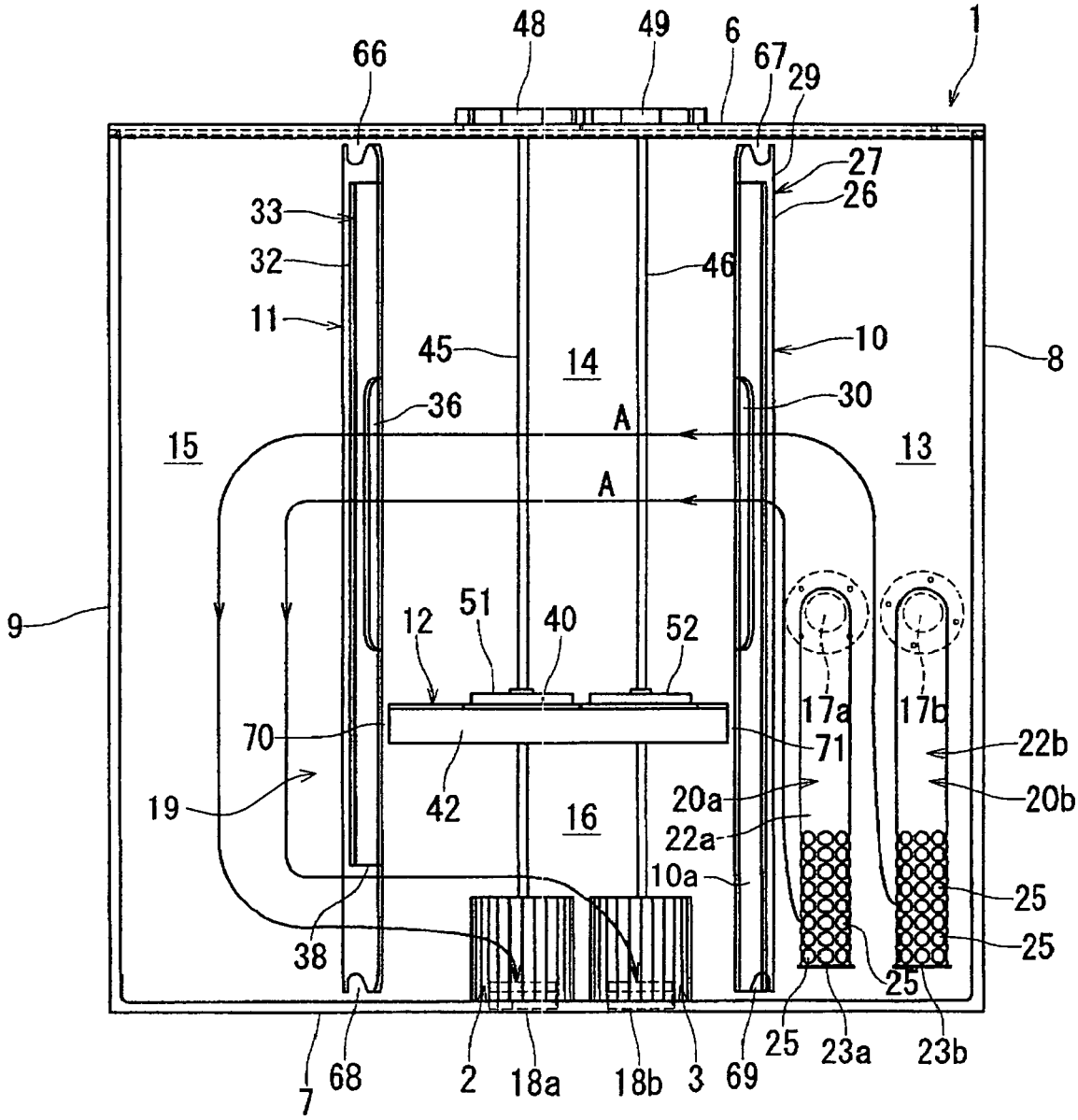
FIG. 1 Cross-sectional front view showing a hydraulic fluid tank according to an embodiment of this invention.
Figure 2:
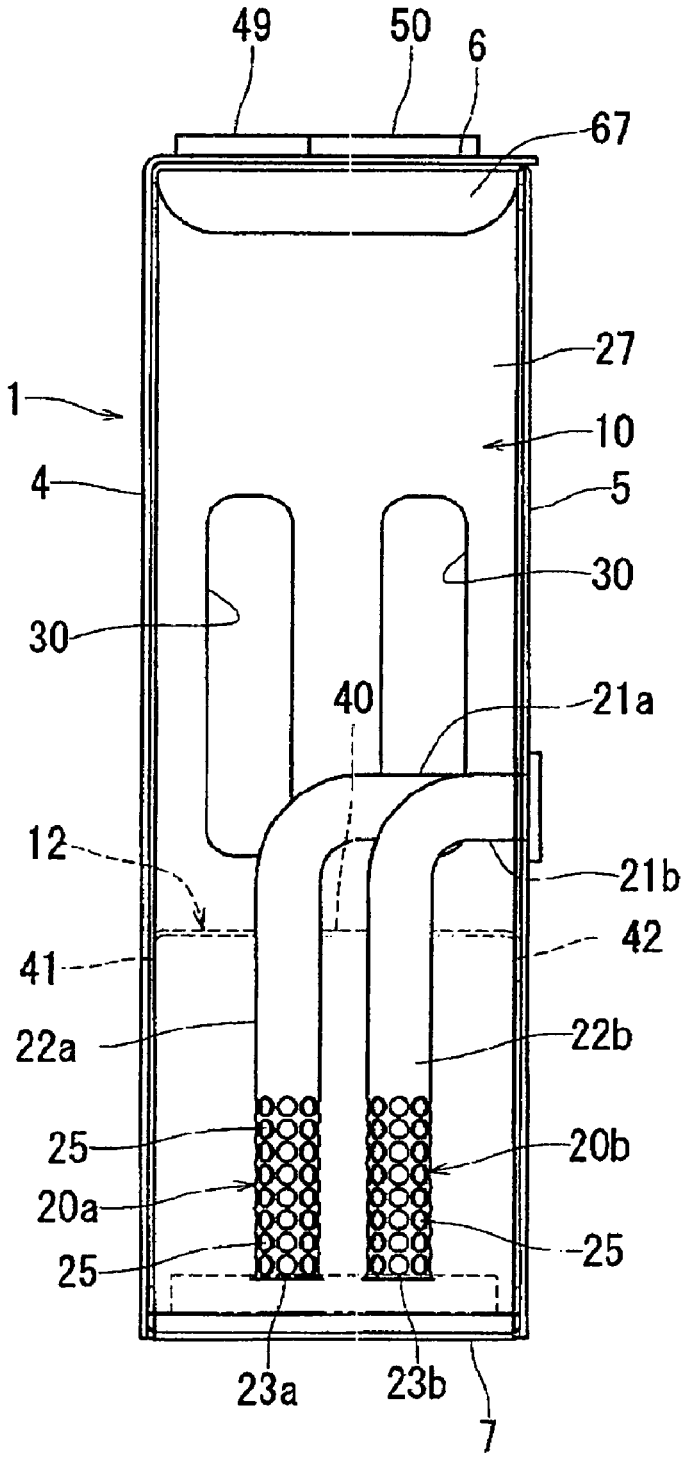
FIG. 2 Cross-sectional side view of the aforementioned hydraulic fluid tank.
Figure 3:
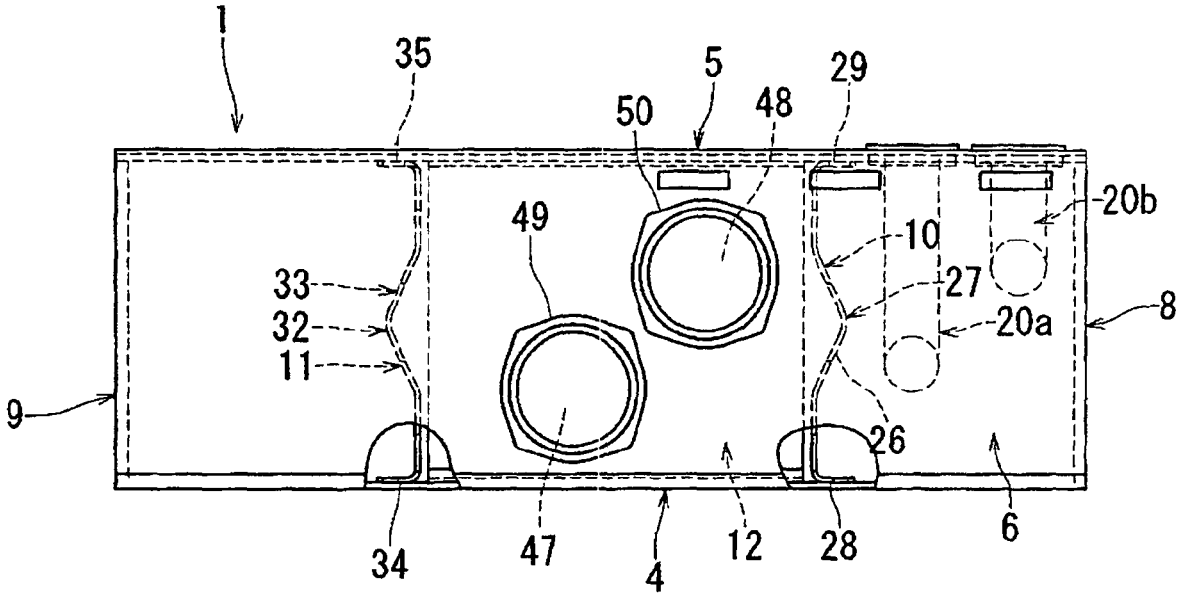
FIG. 3 Plan view of the aforementioned hydraulic fluid tank.
Figure 4:
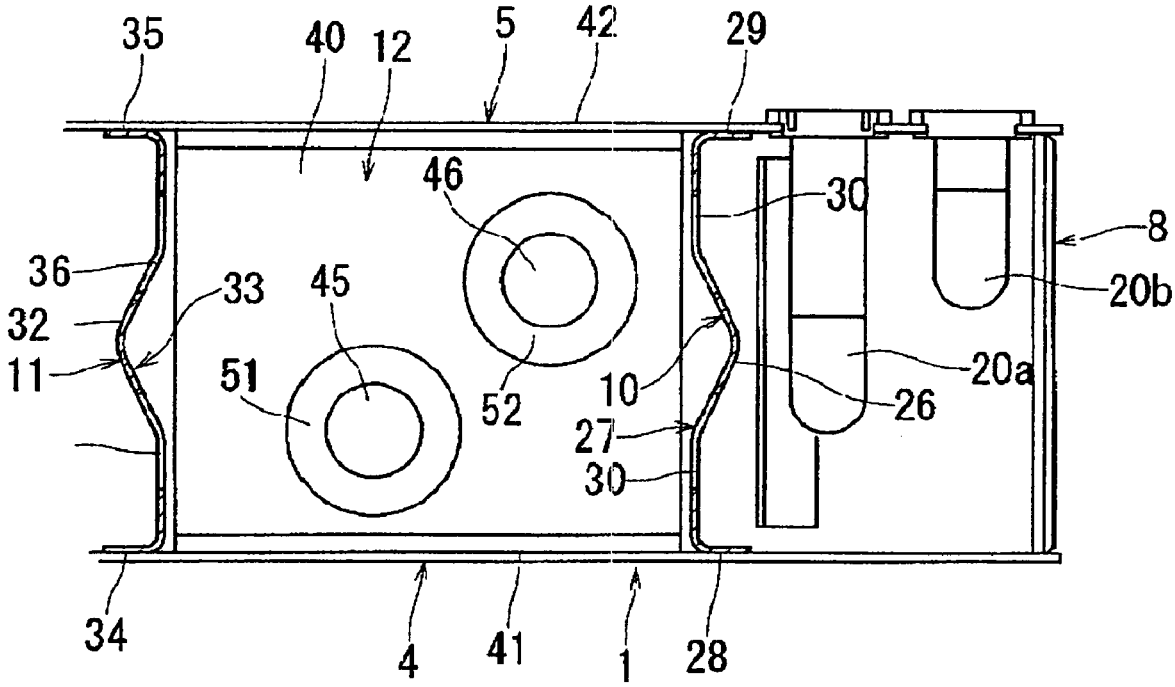
FIG. 4 Cross-sectional plan view of the aforementioned hydraulic fluid tank.

The following description will describe a hydraulic fluid tank according to an exemplary embodiment of this invention with reference to drawings. FIG. 1 is a cross-sectional front view showing this hydraulic fluid tank. FIG. 2 is a cross-sectional side view thereof. FIG. 3 is a plan view thereof. FIG. 4 is a cross-sectional plan view thereof. This hydraulic fluid tank includes a tank main member 1 of a box-shaped member, and a pair of strainers 2 and 3 that are accommodated in this tank main member 1. This tank main member 1 has a front wall (side plate) 4, a rear wall (side plate) 5, a top wall 6, a bottom wall 7, and end walls 8 and 9. In addition, the tank main member 1 has a substantially rectangular outside shape. The front wall 4 and the rear wall 5 have a maximum area among the surfaces that compose the outside shape of the tank main member 1.

Figure 5:
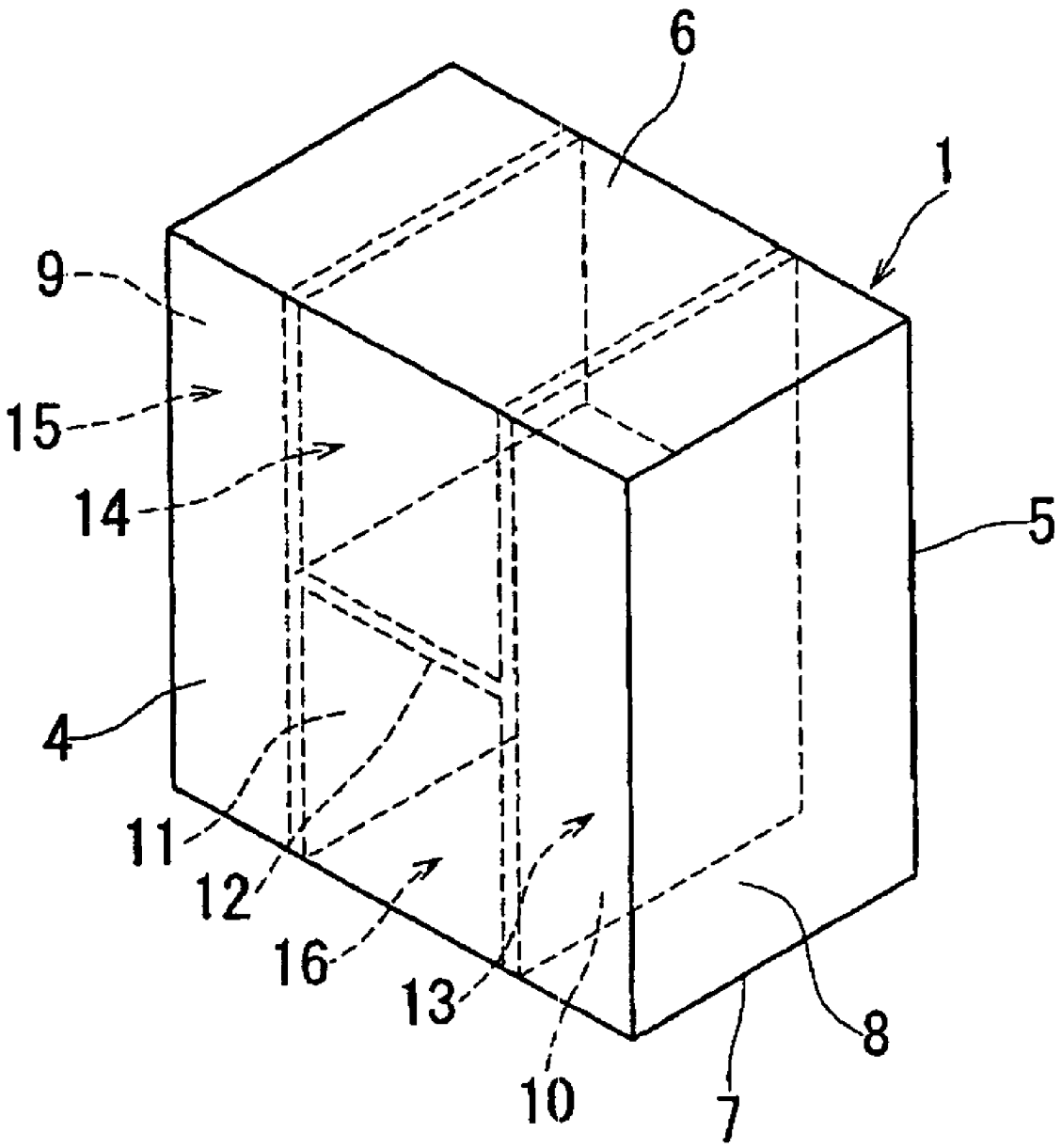
FIG. 5 Schematic perspective view of the aforementioned hydraulic fluid tank.

In addition, as shown in FIGS. 1 and 5, a divider member 19 includes a pair of vertical divider plates 10 and 11 and a horizontal divider plate 12 that vertically divides a part between the vertical divider plates 10 and 11, and is located in the interior of the aforementioned tank main member 1. The interior of this tank main member 1 is divided into a first chamber 13 outside of the vertical divider plate 10 as one of the vertical divider plates, a second chamber 14 of an upper divided part between the vertical divider plates 10 and 11, a third chamber 15 outside of the other vertical plate and a fourth chamber 16 of a lower divided part between the vertical divider plates 10 and 11. Additionally, return ports 17*a* and 17*b* are opened in the first chamber 13, and drawing ports 18*a* and 18*b* are opened in the aforementioned fourth chamber 16.

More specifically, a pair of the return ports 17*a* and 17*b* are located on the rear wall 5 in a part corresponding to the first chamber 13. Fluid guide tubes 20*a* and 20*b* are connected to the return ports 17*a* and 17*b*, respectively. The fluid guide tubes 20*a* and 20*b* include horizontal portions 21*a* and 21*b* that extend from the return ports 17*a* and 17*b*, and vertical portions 22*a* and 22*b* that extend downward from these horizontal portions 21*a* and 21*b*, respectively. In addition, respective lower-end openings 23*a* and 23*b* of the vertical portions 22*a* and 22*b* are opposed to and spaced at a prescribed interval away from the bottom of the first chamber 13. Additionally, the horizontal portion 21*a* of one fluid guide tube 20*a* is longer than the horizontal portion 21*b* of the other fluid guide tube 20*b*. Further, a number of through holes 25 are opened on a peripheral wall in each of lower end parts of the vertical portions 22*a* and 22*b*. Furthermore, the vertical divider plate 10 has a lower portion 10*a* (vertical divider portion) that extends downward from one end of the horizontal divider plate 12 (horizontal divider portion) and is connected to the one end of the horizontal divider plate 12. The lower part 10*a* of the vertical divider plate 10 separates the strainers 2 and 3 from the lower-end openings 23*a* and 23*b* of the fluid guide tubes 20*a* and 20*b*.

In addition, one vertical divider plate 10 includes a main portion 27 with a convex portion 26 that is located in the middle thereof and extends in a vertical direction, and bent portions 28 and 29 that are located on ends of this main portion 27. Additionally, the main portion 27 is provided with a pair of long holes 30. In this case, the bent portion 28 of this vertical divider plate 10 is fastened to the front wall 4 by fastening means such as welding, and the bent portion 29 is fastened to the rear wall 5 by fastening means such as welding. Specifically, the vertical divider plate 10 is dimensioned to be substantially equal to the height of the interior of the tank main member 1.

The other vertical divider plate 11 also includes a main portion 33 with a convex portion 32 that is located in the middle thereof and extends in the vertical direction, and bent portions 34 and 35 that are located on ends of this main portion 33. Additionally, the main portion 33 is provided with a pair of long holes 36. In this case, the bent portion 34 of this vertical divider plate 11 is also fastened to the front wall 4 by fastening means such as welding, and the bent portion 35 is fastened to the rear wall 5 by fastening means such as welding. Specifically, the vertical divider plate 11 is also dimensioned to be substantially equal to the height of the interior of the tank main member 1. Furthermore, a through hole 38 (see FIG. 1) is disposed in a lower part of this vertical divider plate 11 so that the third camber 15 is communicated with the fourth chamber 16 through this through hole 38.

In addition, the vertical divider plate 12 includes a plate-shaped main portion 40, and a bent portion 41 that extends downward from a front end of the main portion 40, and a bent portion 42 that extends downward from a rear end of the main portion 40. The bent portion 41 of the main portion 40 is fastened to the front wall 4 by fastening means such as welding, and the bent portion 42 is fastened to the rear wall 5 by fastening means such as welding.

In addition, the main portion 40 of this horizontal divider plate 12 is provided with strainer-passage holes 43 and 44 (see FIG. 4) that receive the strainers 2 and 3 installed to the tank main member 1. On the other hand, the strainers 2 and 3 are arranged corresponding to the drawing ports 18*a* and 18*b*, respectively. Rods 45 and 46 extend from the strainer 2 and 3, respectively. Cap members 49 and 50 that close through holes 47 and 48 of the top wall 6 are attached to the top ends of the strainer rods 45 and 46. In this case, the strainer rods 45 and 46 press the strainer 2 and 3, respectively, toward the bottom wall 7 by spring members (not shown). Additionally, the strainers 2 and 3 have a cylindrical shape with a top wall, and enclose the drawing ports 18*a* and 18*b*, respectively.

In addition, disk-shaped lid members 51 and 52 are attached to the strainer rods 45 and 46, respectively. These lid members 51 and 52 substantially close the strainer-passage holes 43 and 44, respectively, on the upper side. In this case, although the lid members 51 and 52 are preferably in tight contact with the main portion 40 of the horizontal divider plate 12, a clearance may exist to some extent.

In the aforementioned hydraulic fluid tank, fluid flows from the return ports 17*a* and 17*b* into the first chamber 13 through the number of through holes 25 of the fluid guide tubes 20*a* and 20*b*, the fluid which flows into the first chamber 13 flows upward in the first chamber 13 and then flows through the long holes 30 of the vertical divider plate 10 as one of the vertical divider plates into the second chamber 14. Subsequently, the fluid flows in this second chamber 14 toward the other end side in the width direction, and then flows through the long holes 36 of the vertical divider plate 11 as the other vertical divider plate into the third chamber 15. Additionally, the fluid flows downward in the third chamber 15, and then flows from the third chamber 15 through the through hole 38 of the other vertical divider plate 11 into the fourth chamber 16. After that, the fluid flows through the strainers 2 and 3, and then is drawn through the drawing ports 18*a* and 18*b* by a hydraulic pump (not shown). As discussed above, the pair of vertical divider plates 10 and 11 and the horizontal divider plate 12 define a flow path where fluid flows in the tank main member 1. The fluid which flows along this flow path makes one turn in the vertical direction and one turn in the width direction. That is, fluid flows from the first chamber 13 to the second chamber 14, to the third chamber 15, and to the fourth chamber 16 as shown by arrows A. Accordingly, the distance from the return ports 17*a* and 17*b* to the drawing ports 18*a* and 18*b* can be long. Therefore, it is possible to efficiently remove air (remove bubbles) from fluid containing air (fluid mixed with air). Additionally, since this construction provides fluid less containing air, the tank volume can be reduced compared with conventional tanks, and the tank can be compact in size. Furthermore, since the tank is constructed so that fluid flows in the width direction such as cases where fluid flows from the first chamber 13 to the second chamber 14 and to the third chamber 15, and fluid flows from the third chamber 15 to the fourth chamber 16, the distance of fluid flow is less prone to decrease due to fluid amount reduction compared with a case fluid flows in the vertical direction.

In addition, since the pair of vertical divider plates 10 and 11, and the horizontal divider plate 12 are connected (fastened) to the tank main member 1, these three divider plates 10, 11 and 12 can serve as reinforcement members. For this reason, it is possible to reduce plate thickness of the tank main member 1, or reduce the number of other reinforcement members. Additionally, the strainer-passage holes 43 and 44 can be substantially closed by the lid members 51 and 52, thus, it is possible to prevent that these strainer-passage holes 43 and 44 form a fluid path. Accordingly, it is possible to prevent that a bypass is formed from the second chamber 14 to the fourth chamber 16, thus, it is possible to prevent that the distance from the return ports 17*a* and 17*b* to the drawing ports 18*a* and 18*b* is reduced. Therefore, it is possible to prevent reduction of air removal (bubble removal) function.

In addition, in the foregoing embodiment, clearances 66, 67, 68 and 69 are provided between each of top ends of the vertical divider plates 10 and 11, and an inner surface of the top wall 6 of the tank main member 1, and between each of lower ends of the vertical divider plates 10 and 11, and an inner surface of the bottom wall 7 of the tank main member 1. Additionally, clearances 70 and 71 are provided between the horizontal divider plate 12 and each of the vertical divider plates 10 and 11. These clearances are provided in order to relieve stress when fluid sways.

Figure 6:
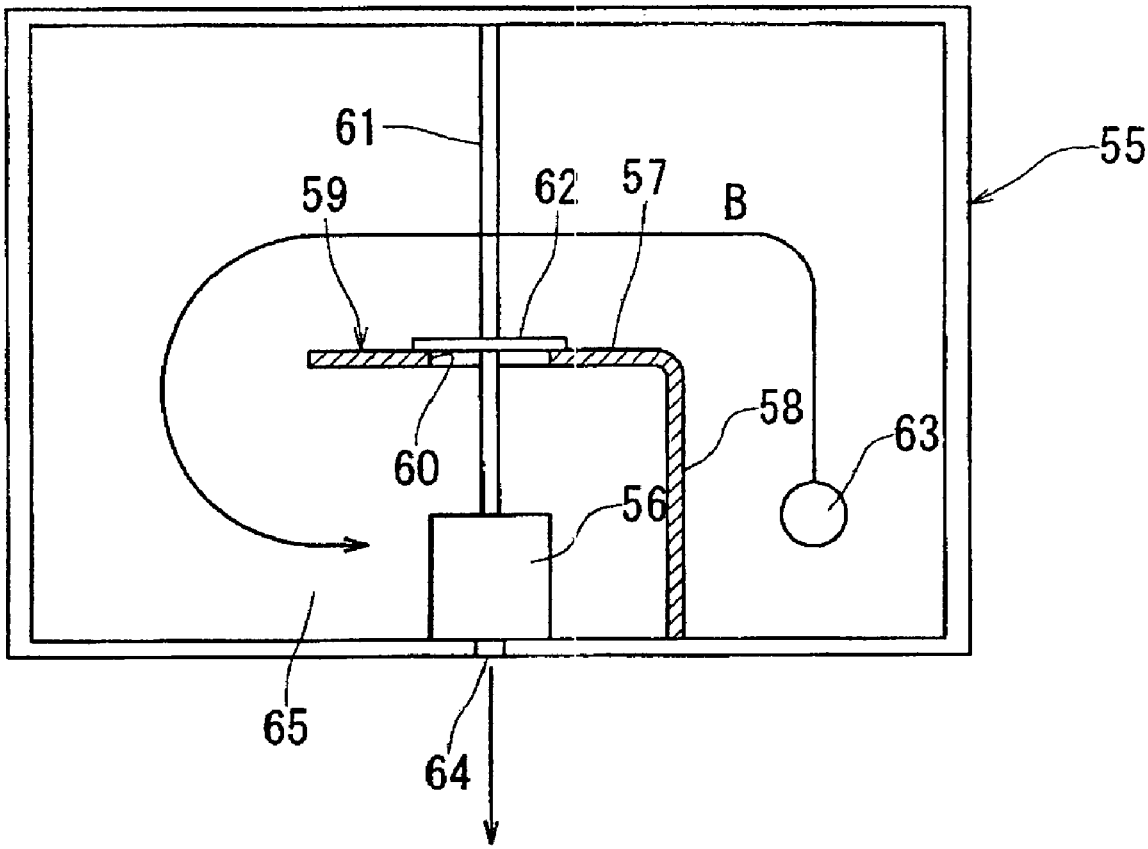
FIG. 6 Schematic cross-sectional view showing a hydraulic fluid tank according to another embodiment of this invention.

FIG. 6 now shows another embodiment. In this case, the interior of the aforementioned tank main member 55 is divided by a divider member 59 including a horizontal divider plate 57 (horizontal divider portion) that is located above the strainer 56, and a vertical divider plate 58 (vertical divider portion) that extends downward from one end of this horizontal divider plate 57. In addition, the horizontal divider plate 57 is provided with a strainer-passage hole 60 that is opened therein, and the strainer-passage hole 60 is substantially closed by a Lid member 62 that is attached to a strainer rod 61. Additionally, a return port 63 is opened on one side outward of the vertical divider plate 58 in a width direction, and the strainer 56 encloses a drawing port 64.

Accordingly, in this hydraulic fluid tank, as shown by an arrow B, fluid which flows through the return port 63 into the tank main member 55 flows first upward and then flows toward the other side in the width direction in a part above the aforementioned horizontal divider plate 57, and, subsequently, flows downward on the other side in the width direction. The fluid flows additionally into a part under the horizontal divider plate 57 thorough an opening 65 of the aforementioned divider plate 59 on the other side, and flows through the strainer 56 that is located under this horizontal divider plate 57 and then drawn through the drawing port 64 by a hydraulic pump.

Also, in a case of this hydraulic fluid tank shown in FIG. 6, fluid flows as shown by the arrow B, similarly to the hydraulic fluid tank shown in FIG. 1, thus, a path of fluid flow is defined so that the fluid flow makes at least one turn in the vertical direction and at least one turn in the width direction. For this reason, the distance from the return port 63 to the drawing port 64 can be long, therefore, it is possible to efficiently remove air (remove bubbles) from fluid containing air (fluid mixed with air). Accordingly, similarly to the aforementioned hydraulic fluid tank shown in FIG. 1, since this construction provides fluid less containing air, the tank volume can be reduced compared with conventional tanks, and the tank can be compact in size. Additionally, it is possible to prevent that the strainer-passage hole 60 forms a fluid path, thus, it is possible to prevent that the distance from the return port 63 to the drawing port 64 is reduced. Therefore, it is possible to prevent reduction of air removal (bubble removal) function.

Figure 7:
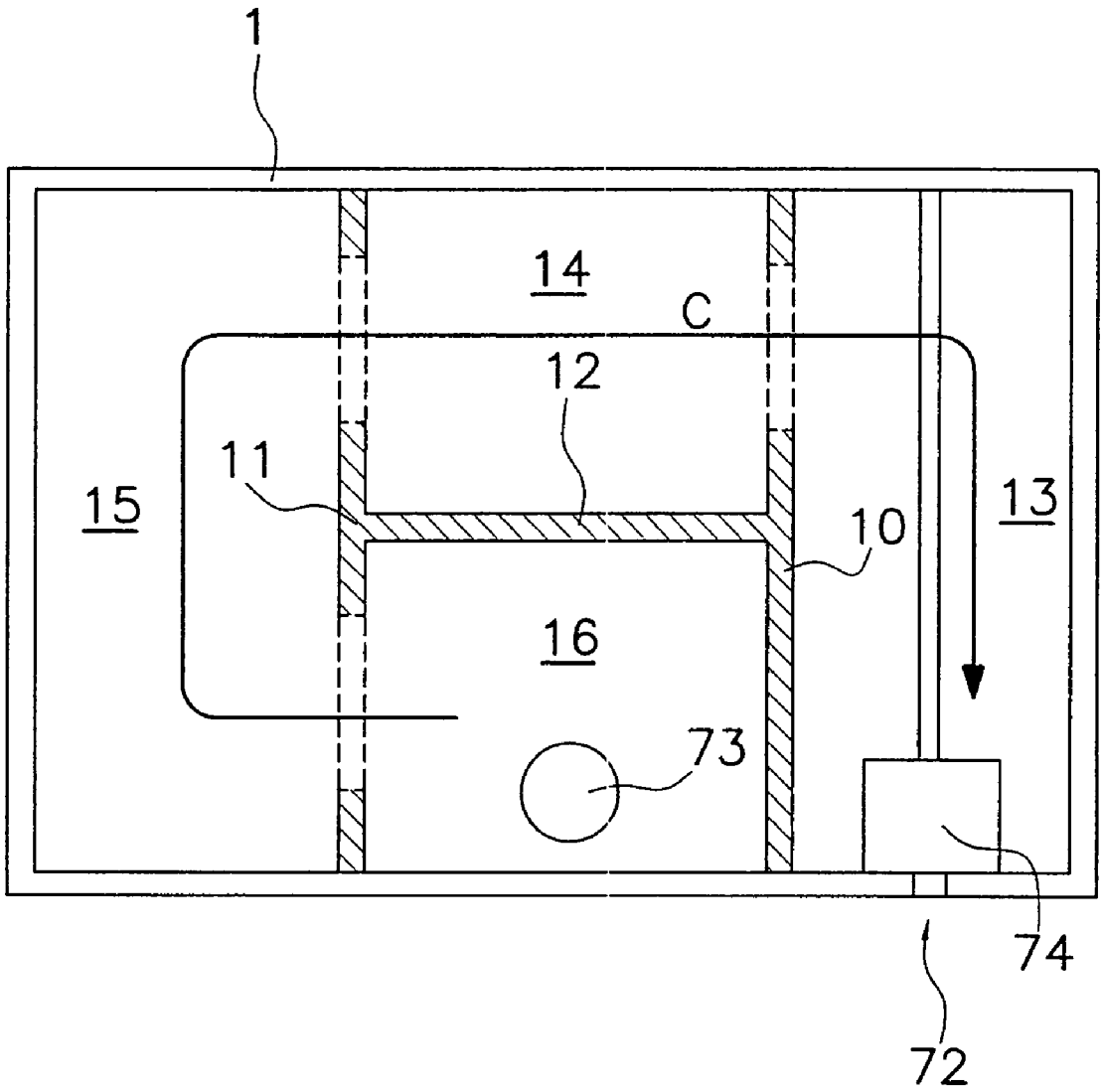
FIG. 7 Schematic cross-sectional view showing a hydraulic fluid tank according to another embodiment of this invention.

FIG. 7 now shows another embodiment. In this case, similarly to the case shown in FIGS. 1 and 5, the tank main member 1 is provided with the vertical divider plates 10 and 11, and the horizontal divider plate 12 are located in the interior thereof, and is divided into the first chamber 13, second chamber 14, third chamber 15 and fourth chamber 16. But, dissimilarly to the case of FIGS. 1 and 5, a drawing port 72 is opened in the first chamber 13, and a return port 73 is opened in the fourth chamber 16. In addition, the drawing port 72 is enclosed by a strainer 74.

Accordingly, in this hydraulic fluid tank, as shown by an arrow C, fluid which flows into the tank main member 1 through the return port 73 flows first in the width direction and in a direction away from the drawing port 72, and then flows upward. Subsequently, the fluid flows in a part above the horizontal divider plate 12 in the width direction and toward the drawing port 72, and then flows downward on other end side of the horizontal divider plate 12. After that, the fluid passes through the strainer 74 that is located in a lower part, and then is drawn through the drawing port 72 by a hydraulic pump.

Also, in a case of this hydraulic fluid tank shown in FIG. 7, since fluid flows as shown by the arrow C, fluid flows from the fourth chamber 16, to the third chamber 15, to the second chamber 14 and to the first chamber 13, the distance from the return ports 17*a* and 17*b* to the drawing ports 18*a* and 18*b* can be long. Accordingly, similarly to the hydraulic fluid tank shown in FIG. 1, thus, a path of fluid flow is defined so that the fluid flow makes at least one turn in a vertical direction and at least one turn in a width direction. For this reason, the distance from the return port 73 to the drawing port 72 can be long, therefore, it is possible to efficiently remove air (remove bubbles) from fluid containing air (fluid mixed with air). Accordingly, similarly to the aforementioned hydraulic fluid tank shown in FIG. 1, since this construction provides fluid less containing air, the tank volume can be reduced compared with conventional tanks, and the tank can be compact in size.

Figure 8:
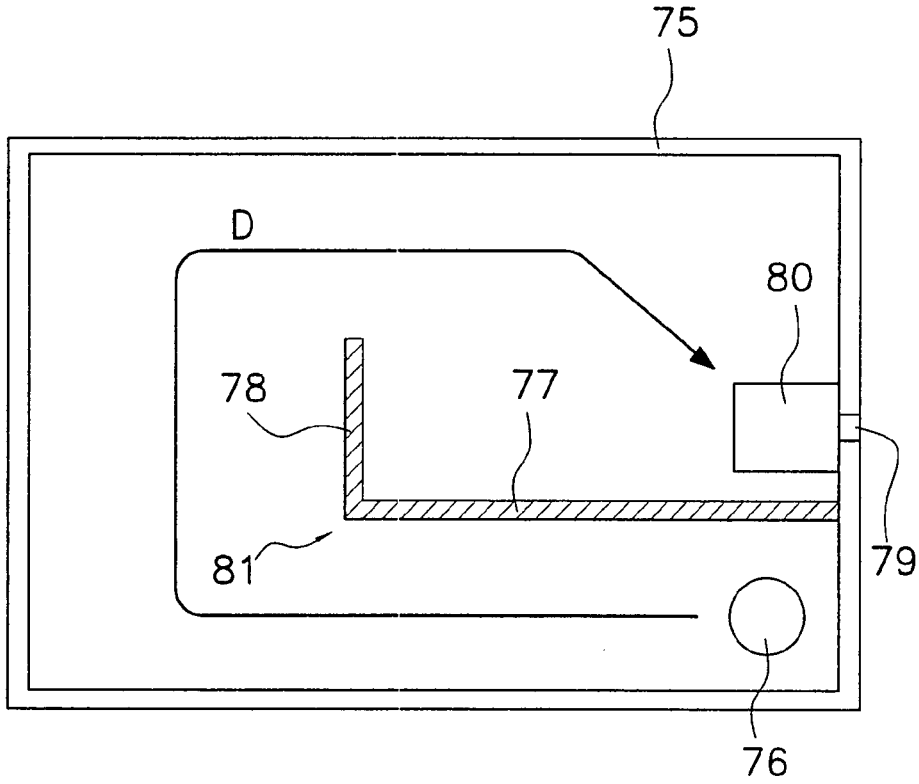
FIG. 8 Schematic cross-sectional view showing a hydraulic fluid tank according to still another embodiment of this invention.
Figure 9:
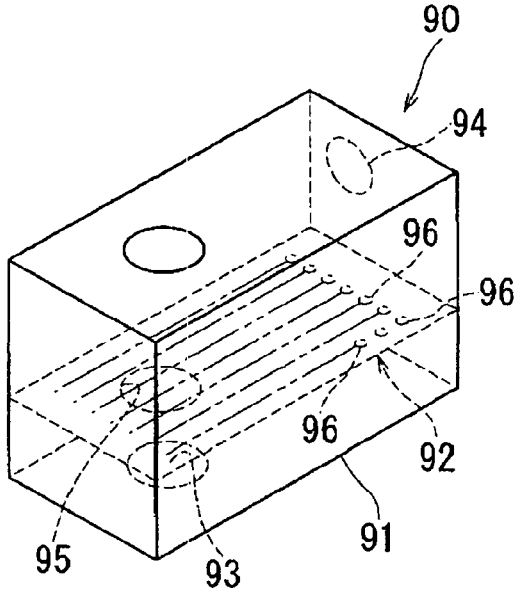
FIG. 9 Schematic perspective view of a known hydraulic fluid tank.
Figure 10:
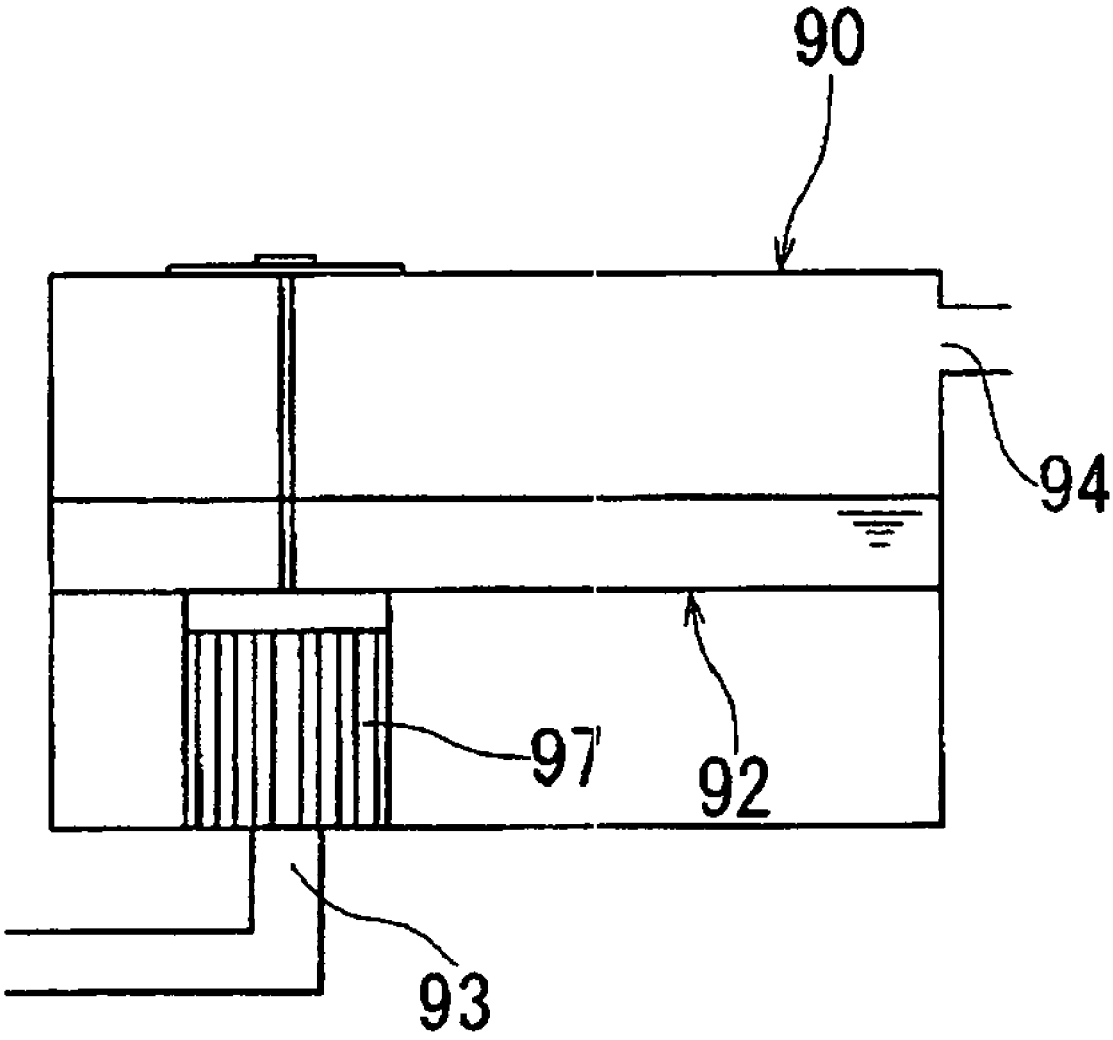
FIG. 10 Schematic cross-sectional view of the known hydraulic fluid tank.
Figure 11:
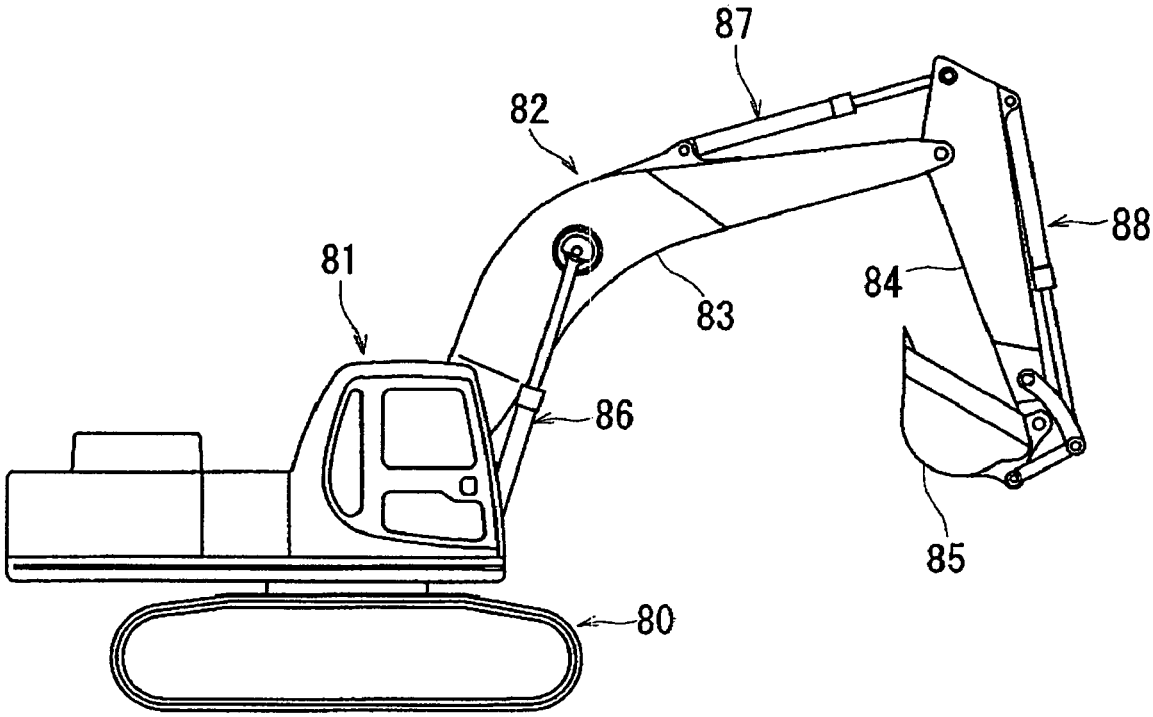
FIG. 11 Schematic view of a construction machine with a hydraulic fluid tank used therein.

FIG. 8 now shows still another embodiment. In this case, the interior of the aforementioned tank main member 75 is divided by a divider member 81 including a horizontal divider plate 77 and a vertical divider plate 78. The horizontal divider plate 77 is located above a return port 76 that is located in a width-direction-side end and lower part of the tank main member 75. The vertical divider plate 78 extends upward from one end of this horizontal divider plate 77. In addition, a drawing port 79 is opened above the return port 76 so as to interpose the vertical divider plate 77 between them. The drawing port 79 is enclosed by a strainer 80. Additionally, the vertical divider plate 78 is located laterally of the strainer 80. The vertical divider plate 78 extends upward to a position higher than the strainer 80.

Accordingly, in this hydraulic fluid tank, as shown by an arrow D, fluid which flows into the tank main member 75 through the return port 76 flows first in the width direction and in a direction away from the drawing port 79, and then flows upward to a position higher than the vertical divider plate 78. Subsequently, the fluid flows in the width direction toward the drawing port 79, and then flows downward. After that, the fluid passes through the strainer 80, and then is drawn through the drawing port 79 by a hydraulic pump.

Also, in a case of this hydraulic fluid tank shown in FIG. 8, fluid flows as shown by the arrow D, similarly to the hydraulic fluid tank shown in FIG. 1, thus, a path of fluid flow is defined so that the fluid flow makes at least one turn in a vertical direction and at least one turn in a width direction. For this reason, the distance from the return port 76 to the drawing port 79 can be long, therefore, it is possible to efficiently remove air (remove bubbles) from fluid containing air (fluid mixed with air). Accordingly, similarly to the aforementioned hydraulic fluid tank shown in FIG. 1, since this construction provides fluid less containing air, the tank volume can be reduced compared with conventional tanks, and the tank can be compact in size.

In addition, the hydraulic fluid tank shown in FIG. 8 has a similar effect if the drawing port 79 and the return port 76 are located in reverse orientation.

Although the exemplary embodiments according to this invention are described as above, this invention is not limited to the foregoing embodiments. Various modifications can be made without departing from the scope of this invention. For example, although two return ports 17*a* and 17*b* are provided in a case shown in FIG. 1, or the like, one return port, or three or more ports may be provided. In addition, one strainer, or three or more strainers may be provided. Accordingly, the number of drawing ports may be varied depending on the number of strainers. Additionally, in the hydraulic fluid tanks shown in FIGS. 6 to 8, two or more strainers may be provided. Furthermore, construction machines to which the hydraulic fluid tanks applied are not limited to hydraulic shovels, but include various types of machines such as crane and crusher.

In addition, although the pair of vertical divider plate 10 and 11, and the horizontal divider plate 12 are connected to the front wall 4 and the rear wall 5 in the hydraulic fluid tank of FIG. 1, in a case where a hydraulic fluid tank has an outside shape with a relatively low height, and the area of the top wall 6 and the bottom wall 7 is larger than the other walls, in terms of improvement in reinforcement effect, the pair of vertical divider plates 10 and 11, and the horizontal divider plate 12 can be connected to the top wall 6 and the bottom wall 7.

In addition, in the hydraulic fluid tanks according to the foregoing embodiments, although a path of fluid flow is defined so that the fluid flow makes one turn in a vertical direction and one turn in a width direction, a fluid flow may make two or more turns in each direction. However, in terms of structure simplification, it is preferable that fluid flow makes one turn in each of vertical and width directions, as in the foregoing embodiments.

In addition, although the drawing ports 18*a*, 18*b* and 64 are located in a lower part in the middle in the width direction of the tank main member 1 and 55 in the hydraulic fluid tanks of FIGS. 1 and 6, the present invention can be applied to a case where a drawing port is located in other locations. However, in terms of facilitation of hydraulic fluid drawing through a drawing port even in a case where a tank main member tilts, it is preferable that a drawing port is located in a lower part in the middle in the width direction of a tank main member.

Industrial Applicability

The present invention provides effects that can stably remove bubbles and reduce a tank volume to be compact in size, and is advantageously applied to hydraulic fluid tanks.

What is claimed is:

1. A hydraulic fluid tank comprising:

a tank main member of a box-shaped member including a pair of vertical divider plates, and a horizontal divider plate that are located in an interior thereof, the horizontal divider plate vertically dividing a part between said vertical divider plates, wherein the interior of the tank main member is divided into a first chamber outside of one of the vertical divider plates, a second chamber of an upper divided part between the vertical divider plates, a third chamber outside of the other of vertical divider plates and a fourth chamber of a lower divided part between the vertical divider plates, wherein said first chamber is provided with a return port that is opened therein, and said fourth chamber is provided with a drawing port that is opened therein, each of the vertical divider plates including at least one hole to guide a majority of hydraulic fluid entered into the hydraulic fluid tank from the return port from the first chamber to the second chamber, from the second chamber to the third chamber, and from the third chamber to the fourth chamber to reach the drawing port.

2. The hydraulic fluid tank set forth in claim 1, wherein said drawing port is located in a lower part of said tank main member in a middle in the width direction.

3. The hydraulic fluid tank set forth in claim 1, wherein the pair of vertical divider plates and the horizontal divider plate are connected to a surface that has a maximum surface area defining said tank main member.

4. The hydraulic fluid tank set forth in claim 1, wherein the pair of vertical divider plates and the horizontal divider plate are connected to a side plate of said tank main member.

5. The hydraulic fluid tank set forth in claim 1, wherein clearances are provided among said vertical divider plates and horizontal divider plate.

6. The hydraulic fluid tank set forth in claim 1 further comprising a strainer corresponding to the drawing port, said horizontal divider plate being provided with a strainer-passage hole, and said strainer-passage hole being substantially closed with a lid member that is attached to a strainer rod.

7. The hydraulic fluid tank set forth in claim 1, wherein a clearance is provided between edges of said vertical divider plates and an inner surface of said tank main member.

* * * * *